US006305049B1

(12) United States Patent
Koch

(10) Patent No.: US 6,305,049 B1
(45) Date of Patent: Oct. 23, 2001

(54) TOOL BAR HANDLE

(76) Inventor: Robert D. Koch, 16711 A 28th Pl., Independence, MO (US) 64056

( * ) Notice: Subject to any disclaimer, the term of this patent is extended or adjusted under 35 U.S.C. 154(b) by 0 days.

(21) Appl. No.: 09/497,255

(22) Filed: Feb. 3, 2000

(51) Int. Cl.[7] ..... A47B 81/00

(52) U.S. Cl. ..... 16/110.1; 280/47.34; 16/903; 137/899; 312/902; 312/249.8

(58) Field of Search ..... 16/110.1, 903, 16/DIG. 41; 137/899, 382, 374, 237; 312/902, 249.8, 244, 237, 209; 280/47.19, 47.34; 222/396, 608, 611.1; 128/202.14; 60/325

(56) References Cited

U.S. PATENT DOCUMENTS

| | | | | |
|---|---|---|---|---|
| 3,007,544 | | 11/1961 | Staunt . | |
| 3,507,098 | | 4/1970 | Veres et al. . | |
| 3,928,711 | | 12/1975 | Jakobsen . | |
| 4,138,815 | * | 2/1979 | Williams et al. | 312/209 |
| 4,174,733 | | 11/1979 | Eidsmore et al. . | |
| 4,674,493 | * | 6/1987 | Mitchell | 128/202.14 |
| 4,870,994 | | 10/1989 | Raymond . | |
| 5,038,819 | | 8/1991 | Sutphen . | |
| 5,394,693 | * | 3/1995 | Plyter | 60/325 |
| 5,573,148 | * | 11/1996 | Poole et al. | 222/611.1 |
| 5,598,869 | | 2/1997 | Nelson . | |
| 5,642,898 | * | 7/1997 | Wise | 280/47.19 |
| 5,785,211 | * | 7/1998 | Tieskoetter | 222/396 |
| 5,878,925 | * | 3/1999 | Denkins et al. | 222/608 |
| 6,170,839 | * | 1/2001 | Kizewski | 280/47.19 |

* cited by examiner

*Primary Examiner*—Lynne H. Browne
*Assistant Examiner*—Doug Hutton
(74) *Attorney, Agent, or Firm*—Chase & Yakimo, L.C.

(57) ABSTRACT

A compressed air distribution and battery recharger is provided in a tool bar handle for a tool cabinet. The tool cabinet handle provides outlets for compressed air which is regulated, dried and lubricated for use with pneumatic tools along with a battery charger for recharging power packs for portable electric tools.

6 Claims, 2 Drawing Sheets

TOOL BAR HANDLE

BACKGROUND OF THE INVENTION

This invention relates to a combination tool bar for use with pneumatic tools and, in particular, to a combination toolbar for attachment to a moveable toolbox for use with a plurality of pneumatic and rechargeable electric tools.

Use of pneumatic and rechargeable electric tools is common place in the automotive industry. Space limitations that may be encountered in a workshop in which pneumatic and electric tools are being used are a problem for workshop personnel. Hoses from a source of compressed air to a pneumatic tool are stretched about the workshop. Battery chargers are often piled on top of toolboxes or work surfaces. Pneumatic tool stands and other such equipment take up precious space in the workshop and around the vehicle being built or repaired. Additionally, the cluttered work area is hazardous for the worker.

SUMMARY OF THE INVENTION

It is therefore the primary object of the present invention to provide an air pressure tool bar which combines a compressed air distribution station with a handle for a toolbox or moveable tool cart.

Another important object of the present invention is to provide an air pressure tool bar for a toolbox or moveable tool cart, as aforesaid, which also incorporates a battery charger therein.

Yet another object of the present invention is to provide an apparatus which does not require additional space within a workshop.

Still another important object of the subject invention is to provide an apparatus that reduces clutter associated with separate compressed air stands and battery chargers.

These and other objects of the present invention are achieved by integrating a compressed air station and a battery pack recharger in a tool bar. The tool bar replaces a conventional handle on a moveable tool cart or toolbox thus requiring no additional space in the workshop. In an automobile repair workshop, the mechanic typically places tools from a toolbox on a tool cart or moves the toolbox close to the vehicle to be repaired so that the needed tools are close to the work area. The pneumatic tools used to work on the vehicle may be stored in the toolbox along with portable electric tools and conventional tools such as screwdrivers and socket wrenches. The tool bar provides the convenience of having the compressed air outlets and battery chargers necessary for the pneumatic and portable electric tools respectively integrated with the toolbox without requiring additional space or equipment. Thus the compressed air outlets and battery chargers are always available wherever the toolbox is moved.

Other objects and advantages of this invention will become apparent from the following description taken in connection with the accompanying drawings, wherein is set forth by way of illustration and example, an embodiment of this invention.

DETAILED DESCRIPTION

Figure 1:
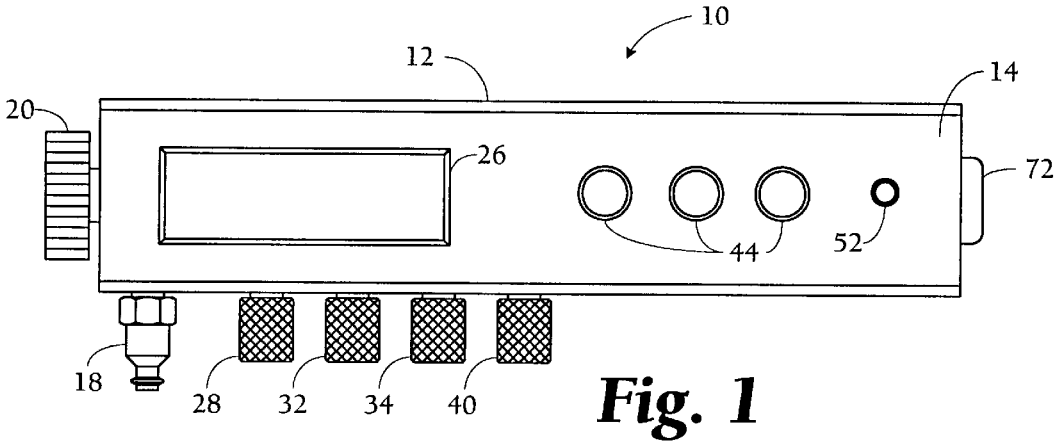
FIG. 1 is a front elevational view of the tool bar.
Figure 2:
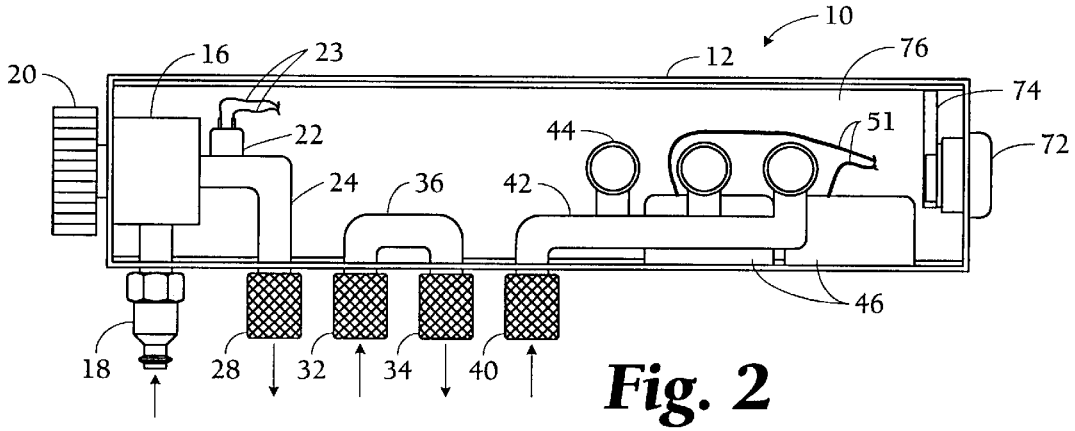
FIG. 2 is a front view of the tool bar of FIG. 1 with the front cover removed to view the internal components.
Figure 3:
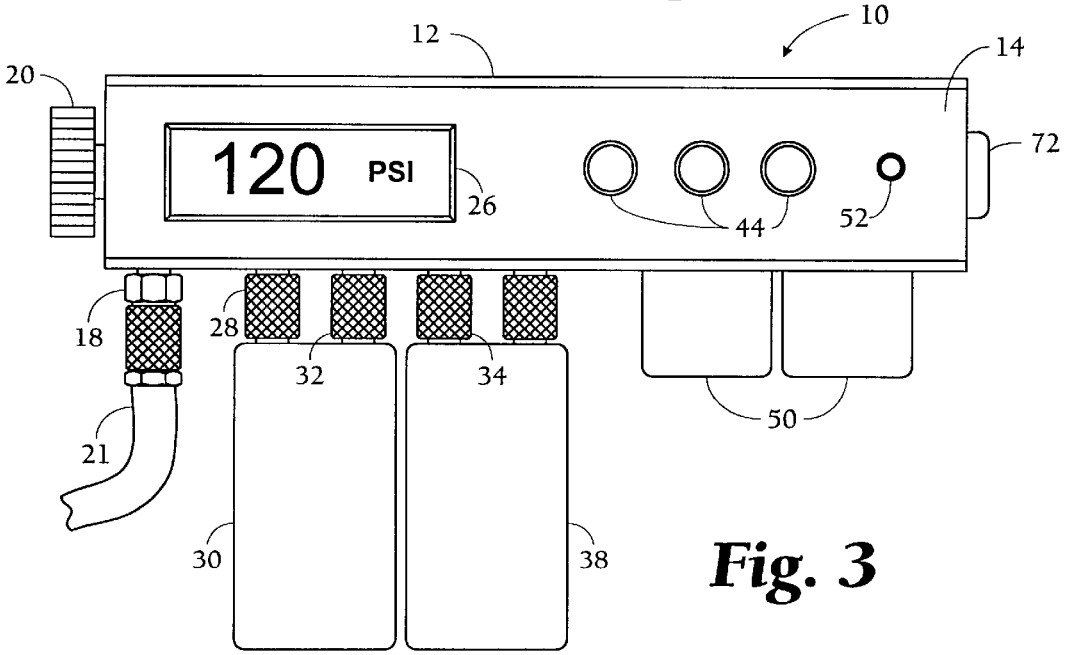
FIG. 3 is a front elevational view of the tool bar of FIG. 1 showing an air hose attached.
Figure 4:
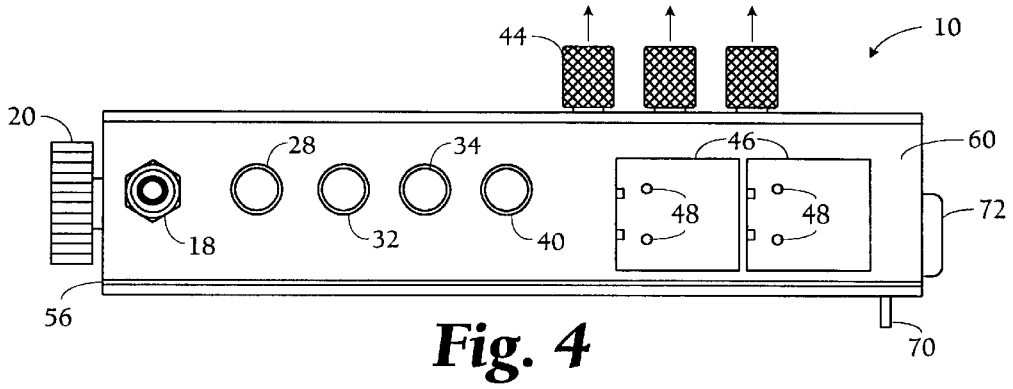
FIG. 4 is a bottom view of the tool bar of FIG. 1.

Turning more particularly to the drawings, the tool bar of the present invention is generally indicated by the reference numeral 10 in FIGS. 1–4. Tool bar 10 comprises an elongated rectangular housing 12 having a front cover 14. As illustrated in FIG. 2 with front cover 14 removed, mounted within housing 12 is an air pressure regulator 16 which is operationally connected to a threaded inlet fitting 18 which is preferably a ¼-inch male snap-on fitting. An air pressure adjustment knob 20 adjustably controls the pressure of the inlet air from a line 21 connected to an air compressor or other compressed air source (not shown). A pressure sensor 22 on regulator air outlet tubing 24 produces an output on line 23 in response to the air pressure in air outlet tubing 24 which is electrically connected to an LED display 26 to indicate the pressure of the regulator 16 outlet air and provide feedback to the operator controlling pressure regulator 16. For example, as illustrated in FIG. 3, the air pressure has been set to 120 psi. A conventional mechanical air pressure dial gauge (not shown) may also be used to display the outlet air pressure for the air pressure regulator 16.

Regulator outlet tubing 24 is operationally connected to water separator fitting 28. Regulated air flows through fitting 28 into water separator 30 where moisture is removed from the air. Dry air returns to housing 12 through fitting 32 which is operationally connected to fitting 34 via air tubing 36. The dry air enters oiler 38 through fitting 34 where lubrication is added to the air. The oiled air returns through fitting 40 to housing 12 and routed through tubing 42 to a plurality of outlet fixtures 44. Air flow directions are shown by directional arrows in FIGS. 2 and 4.

Fittings 28, 32, 34, 40 and 44 are preferably ¼-inch female quick-disconnect fittings or female twist lock fittings.

Recharging receptacles 46 mounted in housing 12 and opening downwardly, for receiving rechargeable batteries or power packs 50 (FIG. 3) for portable electric tools (not shown) each have negative and positive contacts 48 which are electrically connected by wires 51 (FIG. 2) to a female power connector 52 mounted to front cover 14. Alternatively, recharging receptacles may open upwardly so that rechargeable batteries 50 may be held in place by gravity. A power pack 50 may be recharged when inserted into either of receptacles 46 such that the contacts (not shown) on the rechargeable power pack 50 make electrical contact with negative and positive contacts 48 when a 12-volt DC charger (not shown) is plugged into connector 52. Power from connector 52 may also be supplied to LCD display 26 which may alternatively be powered by an internal battery.

Figure 5:
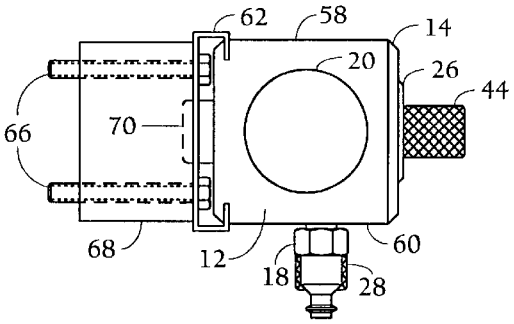
FIG. 5 is a left side view of the tool bar of FIG. 1.
Figure 7:
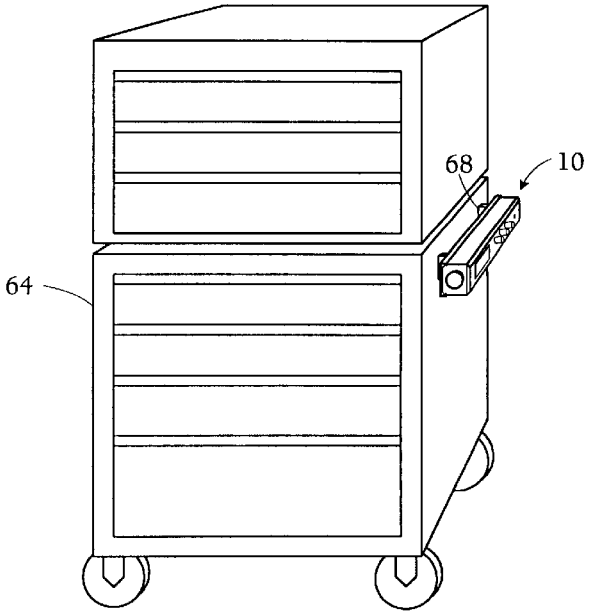
FIG. 7 is a perspective view of the tool bar attached to a tool cabinet.
Figure 6:
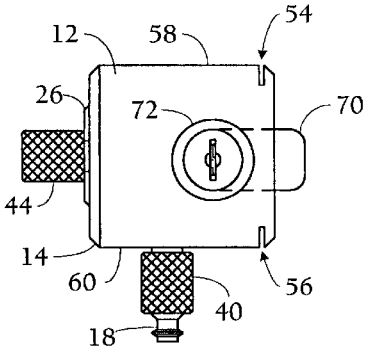
FIG. 6 is a right side view of the tool bar of FIG. 1.

Referring to FIGS. 5–7, an upper 54 and lower 56 channels are provided in housing 12 extending generally parallel to front cover 14 and inwardly to housing 12 from the upper 50 and lower 60 surfaces of housing 12 respectively. Channels 54 and 56 are generally rectangular in cross-section. Mounting bracket 62 is generally C-shaped having upper and lower rails adapted to engage slots 54 and 56, and slidably secure tool bar 10 to a tool chest or cabinet 64. Mounting bracket 62 is secured to tool cabinet 64 by bolts 66 extending through standoffs 68.

Tool bar 10 may be locked to bracket 62 by pivoting a locking blade 70 pivotally secured to lock 72 through a slot 74 in a rear wall 76 of housing 12 (FIG. 2). Locking blade 70 extends through a slot (not shown) in bracket 62 when blade 70 is pivoted into the locking position. To remove tool bar 10, blade 70 may be pivoted through slot 74 into housing 12 using a key (not shown) matched to lock 72.

Referring to FIG. 7, tool bar 10 replaces a conventional handle (not shown) attached to the side of tool cabinet 64 such as a Snap-On roll cabinet, a Sears Craftsman tool cabinet, or a tool cart. Tool bar 10 may be gripped by a shop mechanic, for example, to move tool cabinet 64 about the workshop to a position close to a vehicle (not shown) or other work area. Tool bar 10 provides the worker with the advantage of having the air outlets 44 conveniently located close to the tool storage in the tool cabinet 64 along with the rechargeable battery receptacles 46 (FIG. 4) and the conventional tools stored in the tool cabinet, without the additional battery chargers or pneumatic tool trees and associated power cords and air lines cluttering the work area.

It is to be understood that while certain forms of this invention have been illustrated and described, it is not limited thereto, except in so far as such limitations are included in the following claims.

Having thus described the invention, what is claimed as new and desired to be secured by Letters Patent is as follows:

1. A handle for a tool cabinet or cart comprising:

a handle housing having an interior space and an inlet for receiving a supply of compressed air;

an air pressure regulator mounted in said interior space of said housing for regulating the pressure of said received compressed air, said regulator having an input and an output, said regulator input connected to said inlet to deliver compressed air to said regulator, said regulator delivering said regulated air at a predetermined pressure to said regulator output;

at least one air outlet structure on said housing for delivering said regulated air to a pneumatic tool air line; and at least one battery charger mounted in said housing for recharging a portable electric tool battery.

2. The handle as claimed in claim 1 further comprising:

a water separator for drying said regulated air by removing moisture from said regulated air; and an oiler for adding a lubricant to said dried air from said water separator and delivering said dried and oiled air to said air outlet structure.

3. The handle as claimed in claim 1 wherein said housing is rectangularly shaped.

4. The handle as claimed in claim 3 further comprising:

a first channel extending inwardly from an upper surface of said housing to said interior space of said housing;

a second channel extending inwardly from a lower surface of said housing to said interior space of said housing;

a generally C-shaped bracket secured to said tool cabinet having a downwardly projecting rail and an upwardly projecting rail; said downwardly projecting rail adapted to slidably engage said first channel; said upwardly projecting rail adapted to slidably engage said second channel thereby slidably securing said housing to said tool cabinet.

5. The handle as claimed in claim 4 further comprising a locking means for securing said housing to said bracket.

6. The handle as claimed in claim 1 further comprising a means for indicating said regulated air pressure.

* * * * *